US006481022B1

(12) United States Patent
D'Addario et al.

(10) Patent No.: US 6,481,022 B1
(45) Date of Patent: Nov. 19, 2002

(54) SHOULDER PAD

(75) Inventors: James D'Addario, Old Westbury, NY (US); Carol Catalano, South Hamilton, MA (US)

(73) Assignee: J. D'Addario & Co., Inc., Farmingdale, NY (US)

( * ) Notice: Subject to any disclaimer, the term of this patent is extended or adjusted under 35 U.S.C. 154(b) by 0 days.

(21) Appl. No.: 09/948,480

(22) Filed: Sep. 7, 2001

(51) Int. Cl.[7] ..... A41D 27/26
(52) U.S. Cl. ..... 2/268; 224/643
(58) Field of Search ..... 2/268, 267, 44, 2/45, 459–461, 455, 327, 338; 224/257, 264, 265, 600, 643; 190/115; 206/315.3; D2/639; D29/101.2

(56) References Cited

U.S. PATENT DOCUMENTS

| | | | | |
|---|---|---|---|---|
| 3,799,413 | A | 3/1974 | McBain | |
| 3,883,053 | A | 5/1975 | Pritchard et al. | |
| 4,125,904 | A | 11/1978 | Levine | |
| 4,472,838 | A | 9/1984 | Pompa | |
| 4,550,869 | A | 11/1985 | Johnson | |
| 4,575,874 | A | 3/1986 | Johnson | |
| 4,795,399 | A | 1/1989 | Davis | |
| D302,607 | S | 8/1989 | Krebs et al. | |
| 4,985,931 | A * | 1/1991 | Wingo | 2/268 |
| D337,197 | S | 7/1993 | Krutsch et al. | |
| 5,250,345 | A | 10/1993 | Chu | |
| 5,267,680 | A | 12/1993 | Torok | |
| 5,507,422 | A | 4/1996 | Shields | |
| 5,551,614 | A | 9/1996 | Ham | |
| 5,590,826 | A | 1/1997 | Endo | |
| 5,607,092 | A | 3/1997 | Alexander | |
| 5,765,735 | A | 6/1998 | Kimchi et al. | |
| 5,961,019 | A | 10/1999 | Gleason et al. | |
| D423,782 | S | 5/2000 | Ammerman et al. | |
| D424,301 | S | 5/2000 | Swierz | |
| 6,158,636 | A | 12/2000 | Latiolais | |
| 6,202,214 | B1 | 3/2001 | Light | |
| 6,220,492 | B1 * | 4/2001 | Huang | 224/264 |
| 6,223,959 | B1 | 5/2001 | Chen | |

* cited by examiner

*Primary Examiner*—Gloria M. Hale
*Assistant Examiner*—Tejash Patel
(74) *Attorney, Agent, or Firm*—Gerald T. Bodner

(57) ABSTRACT

A shoulder pad includes a flexible base member having a top surface, a bottom surface, and a longitudinal axis. The flexible base member includes a plurality of longitudinally spaced, oval-shaped pad sections that increase in thickness from a centermost pad section to the longitudinally outermost pad sections. The longitudinally spaced pad sections may also increase in durometer hardness from a centermost pad section to the longitudinally outermost pad sections. For attachment of the pad to a shoulder strap, the pad includes at least one clip for making snap-on engagement with the pad. For added durability, the shoulder pad further preferably includes a thin spine, which is more rigid than the flexible base member and is attached to the top surface of the flexible base member.

24 Claims, 4 Drawing Sheets

SHOULDER PAD

FIELD OF THE INVENTION

The present invention relates generally to a pad for a shoulder strap and more particularly to a shoulder pad having a plurality of longitudinally spaced pad portions that better distribute the load of the strap more evenly over a larger portion of the wearer's shoulder.

BACKGROUND OF THE INVENTION

Pads for shoulder straps are well known in the art. Typically, heavy or bulky items, such as luggage, golf bags, musical instruments, etc., are provided with a shoulder strap for carrying the item around the shoulder, leaving the hands free. Often, the shoulder strap will include one or more pads to absorb and distribute the weight of the item thereby reducing the resulting discomfort in the shoulder area of the person.

Shoulder strap pads to ease some of this discomfort generally fall into two categories. The first, and most typical, is a molded rubber construction with a uniformly thick, generally rectangular shoulder contacting portion and a smaller portion comprising one or two integrally formed loops through which the shoulder strap passes. The second type is similar to the shoulder pad used for golf bags and is a stitched assembly permanently attached to the shoulder strap about equally distant from the opposite ends of the shoulder strap. This type of pad has a body of flexible vinyl or fabric with a non-slip shoulder contacting layer stitched to one face. Both of these shoulder pads are either attached permanently to a particular point on the strap or are slipped on the strap before the fittings, such as buckles, swivel hooks, etc., are attached to the ends of this strap.

In the case of musical instruments, and especially stringed musical instruments (i.e., guitar, bass, mandolin, banjo, etc.), players often must play while standing and need to use a strap to hold their instrument. The strap is usually positioned on the shoulder, as one would carry a piece of luggage or a pocketbook. Some instruments are quite heavy, and after hours of standing during rehearsals and performances, the musician may experience extreme discomfort in the form of shoulder, neck and back pain. In extreme cases, this can result in physical injury.

While providing some comfort to the shoulder area of the wearer, the shoulder strap pads of the prior art fall short in adequately distributing the weight of the item over the shoulder area to minimize discomfort. The weight differential within the width of an ordinary shoulder strap pad may cause a great deal of pressure to the user's shoulder and neck area and, in some cases, may also cause a regional shoulder numbness as a result of reduced blood circulation.

Accordingly, it would be desirable to provide a pad for a shoulder strap that distributes the load or weight of the article carried more evenly over a larger portion of the wearer's back, shoulder and chest.

OBJECTS AND SUMMARY OF THE INVENTION

It is an object of the present invention to provide a pad for a shoulder that better distributes the load or weight of an article to be carried by the pad over a larger portion of a wearer's back, shoulder and chest.

It is another object of the present invention to provide a pad for a shoulder strap that is completely flexible and comfortable for the wearer.

It is yet another object of the present invention to provide a pad for a shoulder strap that can be easily attached to an existing shoulder strap.

The present invention is a shoulder pad comprising a flexible base member having a top surface, a bottom surface, and a longitudinal axis. The flexible base member includes a plurality of longitudinally spaced pad sections that preferably increase in thickness from a centermost pad section to the longitudinally outermost pad sections.

In an alternative embodiment, the longitudinally spaced pad sections increase in durometer hardness from a centermost pad section to the longitudinally outermost pad sections. In this alternative embodiment, the pad sections may be of uniform thickness or may increase in thickness from a centermost pad section to the longitudinally outermost pad sections, as described above.

Preferably, each pad section is oval in shape, having its major axis substantially perpendicular to the longitudinal axis of the flexible base member. In the preferred embodiment, the pad sections are molded integrally with the flexible base member and include a plurality of tubular flexible fingers molded therein.

The flexible base member is preferably made from a soft plastic material selected from the group consisting of monoprene, santoprene and polyvinyl chloride (PVC) and is formed with a plurality of transverse grooves in the bottom surface between the pad sections thereof for providing greater flexibility to the base member.

For attachment of the pad to a shoulder strap, the pad includes at least one clip mounted to the top surface of the flexible base member for engaging the shoulder strap. Preferably, the clip is removably mounted to the top surface of the flexible base member and is provided with an adapter that cooperates with the clip for allowing attachment of the pad to shoulder straps of varying widths.

For added durability, the shoulder pad further preferably includes a thin spine, which is more rigid than the flexible base member, attached to the top surface of the flexible base member. In this case, at least one clip is attached to a top surface of the spine for attaching the pad to a shoulder strap.

A preferred form of the shoulder pad, as well as other embodiments, features and advantages of this invention, will be apparent from the following detailed description, which is to be read in conjunction with the accompanying drawings.

DETAILED DESCRIPTION OF THE PREFERRED EMBODIMENTS

Figure 1:
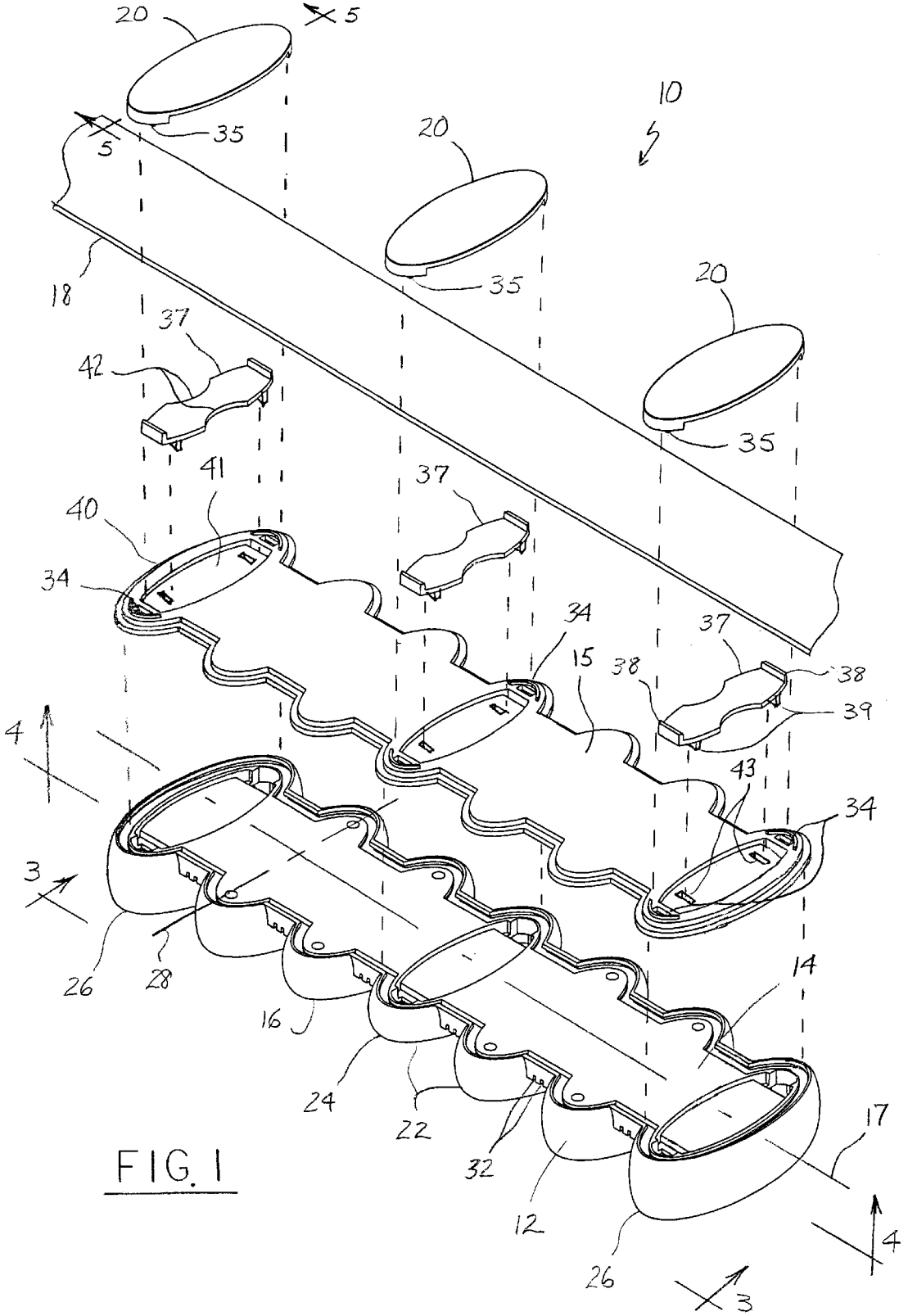
FIG. 1 is an exploded top perspective view of the shoulder pad formed in accordance with the present invention.

Referring to FIGS. 1–5, a shoulder pad 10 formed in accordance with the present invention is shown. The pad 10 generally includes an elongate flexible base member 12 having a top surface 14, a bottom surface 16 and a central longitudinal axis 17. As will be discussed in further detail below, the pad 10 is preferably attached to a strap 18 along the top surface of the pad by means of snap-on clips 20.

The base member 12 is preferably molded from a relatively soft elastic plastic material, such as monoprene, santoprene, polyvinyl chloride (PVC), or other polymer or rubber that can be made of varying durometer hardness. In the preferred embodiment, the base member 12 includes a plurality of longitudinally spaced pad sections 22 integrally molded therewith. Thus, the unitary base member 12 with pad sections 22 is molded out of a flexible material in a single mold. In an alternate embodiment, however, the base member 12 and the pad sections 22 may be formed separately and joined together subsequently, for example, by means of an adhesive. In further alternate embodiments, the base member 12 and the pad sections 22 may be made from different materials and/or take the form of an inflatable pad.

Preferably, the pad sections 22 increase in thickness outwardly from a centermost pad section 24 to the longitudinally outermost pad sections 26, as shown in FIGS. 1–4. In other words, the centermost pad section 24 is the thinnest of the pad sections 22, and each outwardly adjacent pad section becomes gradually thicker so that the longitudinally outermost pad sections 26 are the thickest. This arrangement ensures contact with the body at the outer most pad sections 26, thus distributing the weight of the article supported by the pad over a larger area.

Figure 6:
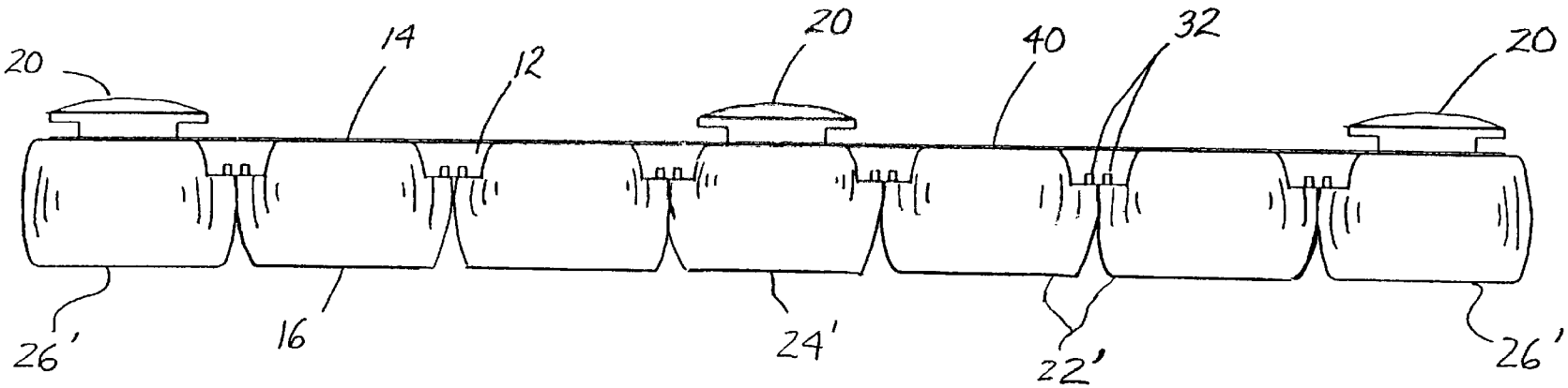
FIG. 6 is a front view of an alternative embodiment of the shoulder pad formed in accordance with the present invention.

In an alternative embodiment, which is particularly suited for pad sections that are formed separately and joined together subsequently, the pad sections 22' increase in durometer hardness from a centermost pad section 24' to the longitudinally outermost pad sections 26'. In this alternative embodiment, the pad sections may be of uniform thickness, as shown in FIG. 6, or may increase in thickness from a centermost pad section to the longitudinally outermost pad sections, as described above. In other words, the centermost pad section 24' is the softest or spongiest of the pad sections 22', and each outwardly adjacent pad section becomes gradually harder or firmer so that the longitudinally outermost pad sections 26' are the hardest or firmest. Thus, when bearing weight against the shoulder of a wearer, the centermost pad section 24' will compress the most, while the outermost pad sections 26' will compress the least, thereby distributing the weight evenly over the entire pad.

Figure 2:
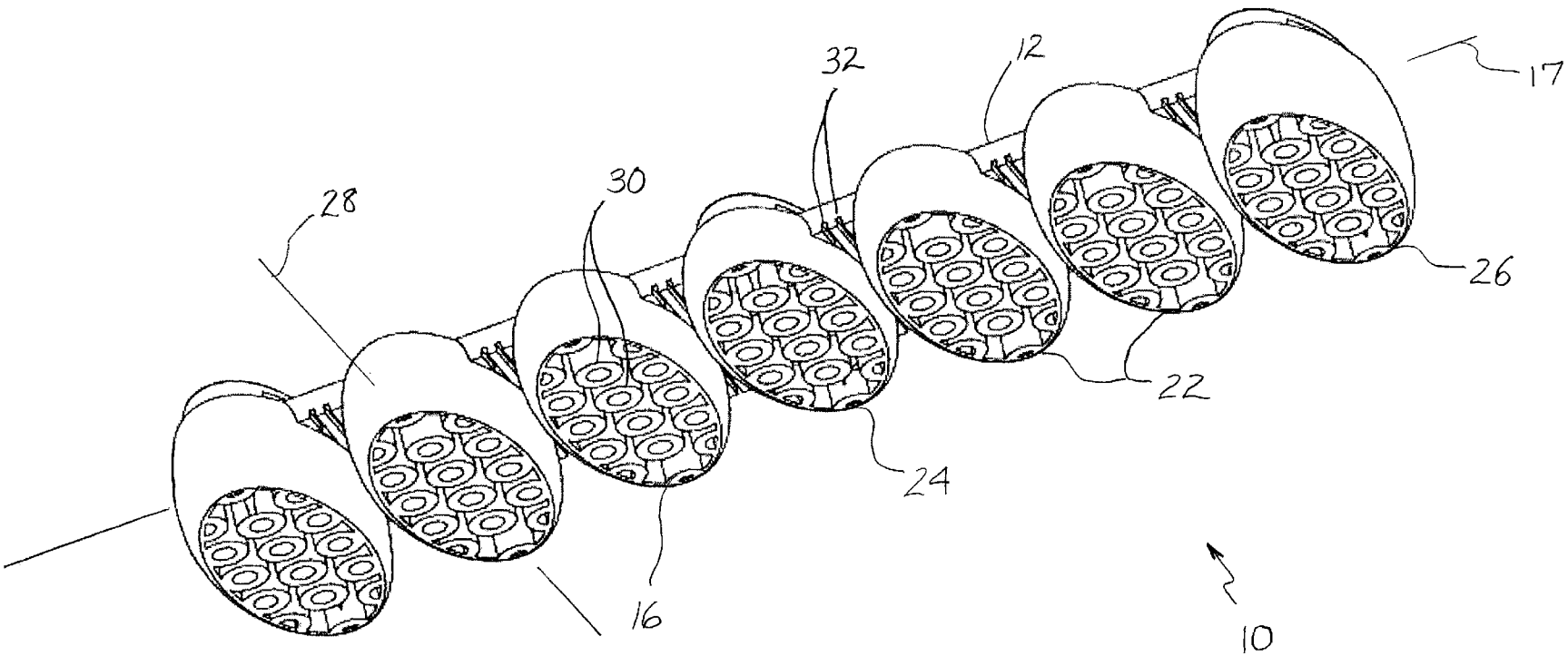
FIG. 2 is a bottom perspective view of the shoulder pad shown in FIG. 1.
Figure 3:
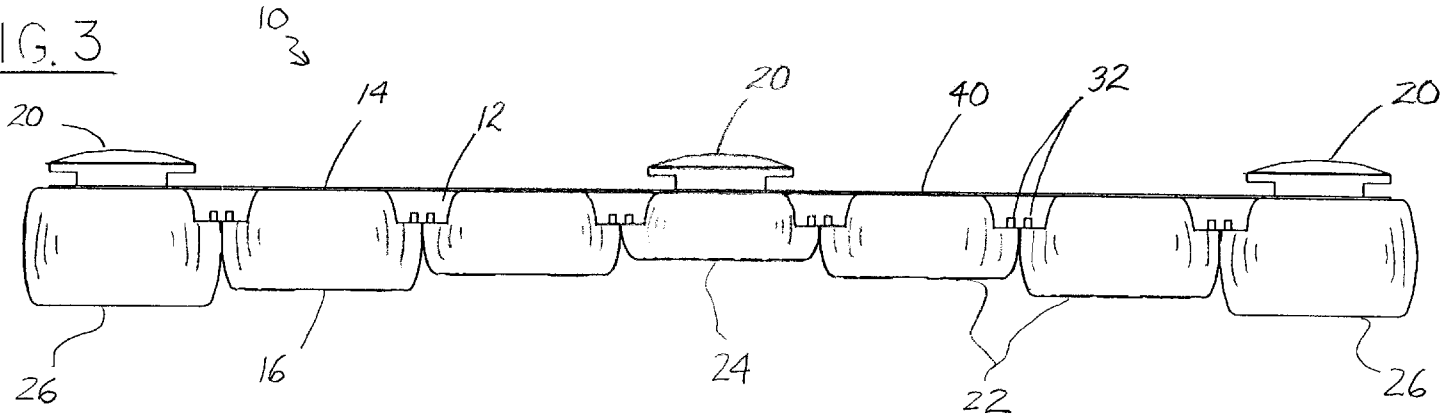
FIG. 3 is a front view of the shoulder pad shown in FIG. 1 taken along the line 3—3.
Figure 4:
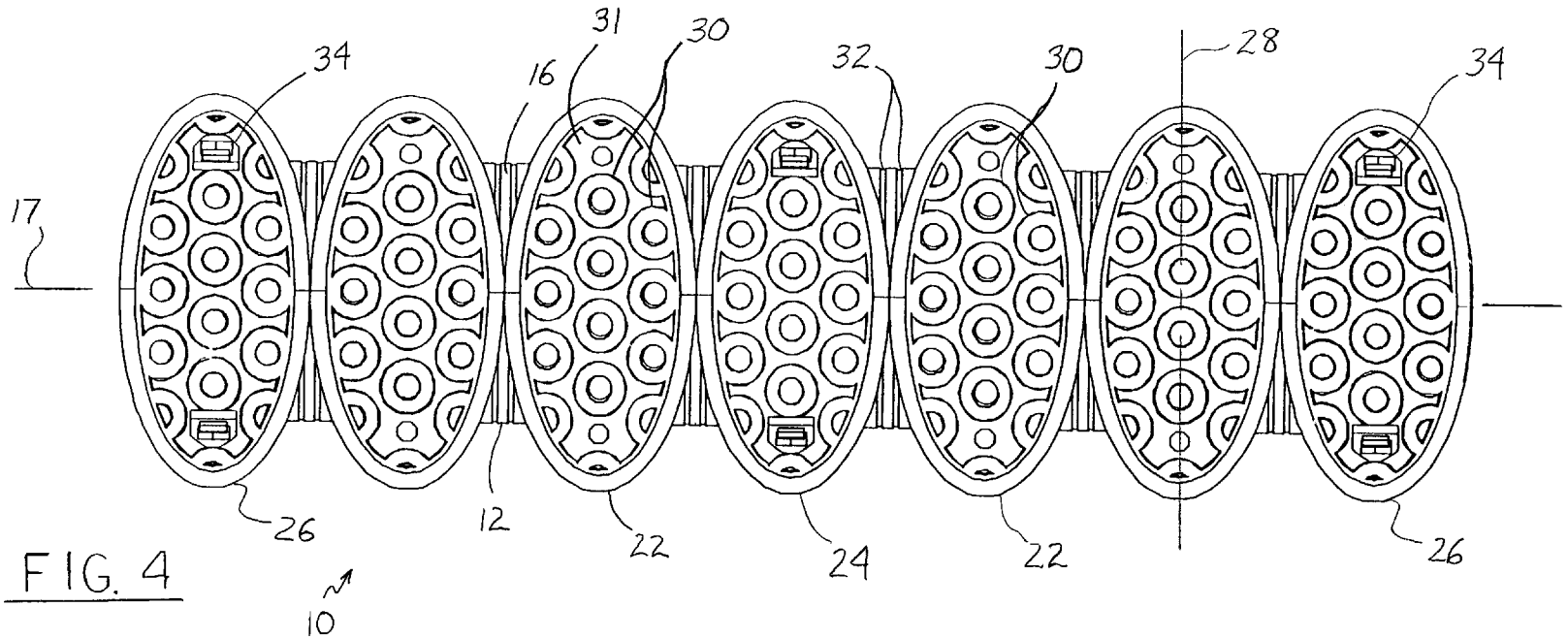
FIG. 4 is a bottom view of the shoulder pad shown in FIG. 1 taken along the line 4—4.

Preferably, there are seven pad sections 22 that are oval in shape and are arranged so that the major axes 28 of the oval pad sections extend perpendicularly to the longitudinal axis 17 of the base member 12. As shown in FIGS. 2 and 4, each pad section 22 further preferably includes a plurality of tubular flexible fingers 30 molded therein. The fingers 30 are compressible and extend from an inner surface 31 of the pad section 22 and terminate flush with the bottom surface 16 of the base member 12. In alternative embodiments, the flexible fingers 30 may take the form of rings, ribs or other flexible and compressible shapes. Thus, when resting on a shoulder of a wearer, the flexible fingers 30 provide increased comfort and flexibility to the pad 10.

Additionally, a plurality of notches or grooves 32, extending transversely to the longitudinal axis 17 of the base member 12, are formed in the base member 12 between the pad sections 22 to allow more flexible bending of the pad around the shoulder of the wearer. The result is a very comfortable feeling pad that minimizes fatigue in the affected areas.

For added durability, the pad 10 further preferably includes a thin spine 40 having a bottom surface attached to the top surface 14 of the base member 12. The spine 40 corresponds in shape to the base member 12 and is made from a flexible but slightly more rigid material than the base member 12 to add strength to the pad. One such suitable material for the spine 40 is polypropylene. Preferably, the base member 12 is molded over the spine 40 to secure it thereto. Alternatively, the spine 40 may be attached to the base member 12 by means of an adhesive.

Figure 5:
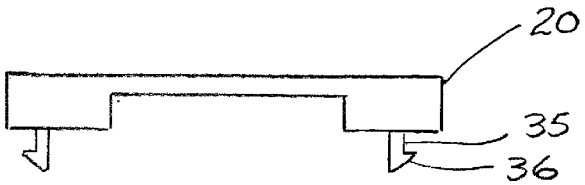
FIG. 5 is a cross-sectional view of one of the clips shown in FIG. 1 taken along the line 5—5.

As mentioned above, the pad 10 is preferably attached to a strap 18 by at least one snap-on clip 20. Of course, any other type of attachment means may be utilized, such as molded-in loops or fabric straps. However, in the preferred embodiment, the top surface 15 of the spine 40 includes at least one aperture 34 which cooperates with a resilient cantilevered finger 35 formed on the clip 20. As shown in FIG. 5, the finger 35 includes a projection 36 at the distal end thereof for engaging the aperture 34 of the spine 40 for snap-on engagement. The strap 18 is placed on the top surface 15 of the spine 40 and the clip 20 is snapped onto the spine, trapping the strap therebetween to secure the pad to the strap. Preferably, the spine 40 includes two apertures 34 formed on the top surface 15 adjacent the centermost pad section 24 and two apertures adjacent each of the outermost pad sections 26 for snap-on engagement of three clips 20, each having two fingers 35, to ensure secure attachment of the pad.

The pad 10 also preferably includes adapters 37 to account for straps of varying widths. The adapters 37 are thin planar members that are frictionally captured within recesses 41 formed on the spine 40. The adapters 37 further include finger cut-outs 42 to allow grasping of the adapter for easy removal from the recess 41 of the spine 40. At least one side of the adapter 37 includes two generally parallel upstanding walls 37 formed thereon at a predetermined distance apart. The other side of the adapter may be left flat or, in the preferred embodiment, may include a second pair of generally parallel upstanding walls 39 formed thereon at a second predetermined distance apart. For example, standard strap widths for stringed musical instruments are either 2 inches, 1.75 inches or 1.5 inches. Accordingly, the spacing for the first pair of walls 38 would be 1.75 inches while the spacing for the second pair of walls would be 1.5 inches. Thus, depending upon the orientation of the adapter 37 within the recess 41 of the spine 40, a 1.75 inch wide strap can be retained or a 1.5 inch strap can be retained. For a 2 inch wide strap, the adapter 37 is simply removed and the strap is retained by a 2 inch wide clearance in the clip 20 alone. Preferably, slots 43 are provided in the recesses 41 of the spine to provide clearance for the walls 38 and 39 of the adapters 37. Thus, the snap-on clips 20 and adapters 37 make it possible to snap the pad onto most existing straps.

Thus, the shoulder pad of the present invention provides improved weight distribution over a larger portion of a wearer's back, shoulder and chest. Furthermore, the pad is completely flexible and comfortable for the wearer and can be easily attached to an existing shoulder strap. The shoulder pad according to the present invention can be used on straps for luggage, golf bags, briefcases, musical instruments, or any other bag that uses a shoulder strap. Additionally, the pad according to the present invention can be used on such musical instruments that rest directly on a person's shoulder without a strap, such as a violin.

Although illustrative embodiments of the present invention have been described herein with reference to the accompanying drawings, it is to be understood that the invention is not limited to those precise embodiments and various other changes may be effected herein by one skilled in the art without departing from the scope or the spirit of the invention.

What is claimed is:

1. A shoulder pad comprising a flexible base member having a top surface, a bottom surface, and a longitudinal axis, the base member including a plurality of longitudinally spaced pad sections, each pad section increasing in thickness from a centermost pad section to the longitudinally outermost pad sections, and further comprising a thin spine having a top surface and a bottom surface, the bottom surface being attached to the top surface of the flexible base member and the spine being more rigid than the flexible base member.

2. The shoulder pad as defined by claim 1, wherein each pad section is oval in shape having its major axis substantially perpendicular to the longitudinal axis of the flexible base member.

3. The shoulder pad as defined by claim 1, wherein the pad sections are molded integrally with the flexible base member.

4. The shoulder pad as defined by claim 1, wherein the pad sections include a plurality of flexible fingers molded therein.

5. The shoulder pad as defined by claim 1, wherein the pad further comprises at least one clip mounted to the top surface of the flexible base member for attaching the pad to a shoulder strap.

6. The shoulder pad as defined by claim 5, wherein the top surface of the flexible base member further includes at least one aperture for making snap-on engagement with a finger formed on the at least one clip.

7. The shoulder pad as defined by claim 5, further comprising at least one adapter cooperating with the flexible base member and the at least one clip for allowing attachment of the pad to shoulder straps of varying widths.

8. The shoulder pad as defined by claim 5, wherein the pad includes three snap-on clips for attaching the pad to a shoulder strap.

9. The shoulder pad as defined by claim 1, wherein the pad further comprises at least one clip mounted to the top surface of the spine for attaching the pad to a shoulder strap.

10. The shoulder pad as defined by claim 9, wherein the top surface of the spine further includes at least aperture for mating snap-on engagement with a finger formed on the at least one clip.

11. The shoulder pad as defined by claim 9, further comprising at least one adapter cooperating with the spine and the at least one clip for allowing attachment of the pad to shoulder straps of varying widths.

12. The shoulder pad as defined by claim 9, wherein the pad includes three snap-on clips for attaching the pad to a shoulder strap.

13. The shoulder pad as defined by claim 1, wherein the spine is made from polypropylene.

14. A shoulder pad comprising a flexible base member having a top surface, a bottom surface, and a longitudinal axis, the base member including a plurality of longitudinally spaced pad sections, each pad section increasing in thickness from a centermost pad section to the longitudinally outermost pad sections, the flexible base member further including a plurality of transverse grooves formed in the bottom surface thereof between the pad sections for providing greater flexibility to the base member.

15. The shoulder pad as defined by claim 14, wherein the flexible base member includes seven longitudinally spaced pad sections.

16. The shoulder pad as defined by claim 14, wherein the flexible base member is made from a soft plastic material.

17. The shoulder pad as defined by claim 16, wherein the soft plastic material is selected from the group consisting of monoprene, santoprene and polyvinyl chloride (PVC).

18. A shoulder pad comprising a flexible base member having a top surface, a bottom surface, and a longitudinal axis, the base member including a plurality of longitudinally spaced pad sections, each pad section increasing in durometer hardness from a centermost pad section to the longitudinally outermost pad sections.

19. The shoulder pad as defined by claim 18, wherein each pad section is oval in shape having its major axis substantially perpendicular to the longitudinal axis of the flexible base member.

20. The shoulder pad as defined by claim 18, wherein the pad sections include a plurality of flexible fingers molded therein.

21. The shoulder pad as defined by claim 18, wherein the pad further comprises at least one clip mounted to the top surface of the flexible base member for attaching the pad to a shoulder strap.

22. The shoulder pad as defined by claim 21, further comprising at least one adapter cooperating with the flexible base member and the at least one clip for allowing attachment of the pad to shoulder straps of varying widths.

23. The shoulder pad as defined by claim 18, further comprising a thin spine having a top surface and a bottom surface, the bottom surface being attached to the top surface of the flexible base member and the spine being more rigid than the flexible base member.

24. The shoulder pad as defined by claim 18, wherein the flexible base member includes a plurality of transverse grooves formed in the bottom surface thereof between the pad sections for providing greater flexibility to the base member.

* * * * *